United States Patent [19]

Tsuda et al.

[11] Patent Number: 4,482,889

[45] Date of Patent: Nov. 13, 1984

[54] DEVICE FOR DETECTING FAILURE OF ULTRASONIC APPARATUS

[75] Inventors: Tadashi Tsuda, Nagoya; Seiichiro Hiramatsu, Oobu; Tsuyoshi Maeno; Mitsugi Ohtsuka, both of Chiryu, all of Japan

[73] Assignee: Nippondenso Co., Ltd., Kariya, Japan

[21] Appl. No.: 321,226

[22] Filed: Nov. 13, 1981

[30] Foreign Application Priority Data

Nov. 14, 1980 [JP] Japan ..... 55-160980
Dec. 2, 1980 [JP] Japan ..... 55-170717

[51] Int. Cl.[3] ..... G08B 29/00

[52] U.S. Cl. ..... 340/514; 340/516; 340/653; 367/93; 367/94

[58] Field of Search ..... 340/514, 516, 653, 635; 367/93, 94

[56] References Cited

U.S. PATENT DOCUMENTS 3,727,216 4/1973 Antonio ..... 367/94
4,290,126 9/1981 McFadyen et al. ..... 367/93

*Primary Examiner*—Glen R. Swann, III
*Attorney, Agent, or Firm*—Cushman, Darby & Cushman

[57] ABSTRACT

A device for detecting failure of an ultrasonic apparatus having an ultrasonic pulse generator, an ultrasonic transmitter and an ultrasonic receiver utilizes a damped oscillation signal which is produced at the junction point between the ultrasonic pulse generator and the ultrasonic transmitter when the ultrasonic transmitter or the ultrasonic receiver is excited by applying thereto an ultrasonic pulse generated by the ultrasonic pulse generator. A level discriminator compares the damped oscillation signal with a reference level and determines whether the damped oscillation signal has a sufficient magnitude and duration indicating that the ultrasonic transmitter or the ultrasonic receiver is in a normal operating condition.

7 Claims, 5 Drawing Figures

DEVICE FOR DETECTING FAILURE OF ULTRASONIC APPARATUS

BACKGROUND OF THE INVENTION

1. Field of the Invention

This invention relates to a device for detecting failure of an ultrasonic apparatus which utilizes ultrasonic pulses for the detection of, for example, an obstruction.

2. Description of the Prior Art

An ultrasonic apparatus commonly employed for the detection of an obstruction comprises an ultrasonic pulse generator generating a pulse signal entrained on a carrier and an ultrasonic pulse transmitter transmitting ultrasonic pulses by receiving the pulse signal from the generator. The normal or trouble-free operation of the ultrasonic pulse transmitter in such an ultrasonic apparatus has been confirmed by an ultrasonic pulse receiver which receives a direct ultrasonic pulse. The prior art failure detecting device has therefore been defective in that a receiver is inevitably required for the confirmation of the trouble-free operation of the transmitter, and the apparatus itself cannot confirm the operation of the transmitter.

In another prior art ultrasonic apparatus utilizing ultrasonic pulses for checking a normal operation, a receiving circuit associated with a circuit required for the transmission of ultrasonic pulses detects the time difference between the time of reception of a direct pulse and the time of reception of a reflected pulse. The operation of the device for confirming the normal or trouble-free operation of the ultrasonic apparatus has been such that a display unit displays the trouble-free operation of the entire apparatus when the receiving circuit receives a direct pulse at the time at which the confirmation is required. However, the prior art failure detecting device has a disadvantage in that, in order to receive the direct pulse for the purpose of confirmation of the trouble-free operation, a dead time zone must be provided for distinguishing the direct pulse from the reflected pulse.

SUMMARY OF THE INVENTION

With a view to obviate the prior art defects pointed out above, it is an object of the present invention to provide, in an ultrasonic apparatus including an ultrasonic pulse generating circuit, an ultrasonic pulse transmitter and an ultrasonic pulse receiver for utilizing ultrasonic pulses for the detection of, for example, an obstruction, a device for detecting the failure of the ultrasonic apparatus, in which the damped oscillation signal appearing after the exciting ultrasonic pulse is utilized, so that the ultrasonic apparatus itself can confirm its operation, that is, it can perform the so-called self-check.

In the failure detecting device of the present invention for detecting failure of an ultrasonic apparatus utilizing ultrasonic pulses for the detection of, for example, an obstruction, the damped oscillation signal appearing as a result of excitation of the ultrasonic transmitter or the ultrasonic receiver by an ultrasonic pulse is derived from the junction point between the ultrasonic pulse generator and the ultrasonic transmitter or ultrasonic receiver, and the state of the damped oscillation signal is checked to detect failure that may have occurred in the ultrasonic apparatus. The present invention is therefore advantageous in that the failure can be detected by the self-check based on the processing of internal signals of the ultrasonic apparatus itself without the prior art necessity for detecting the direct pulse, and the elimination of the necessity for the direct pulse detection can shorten the period of time required for the failure detection.

DESCRIPTION OF THE PREFERRED EMBODIMENTS

Figure 1:
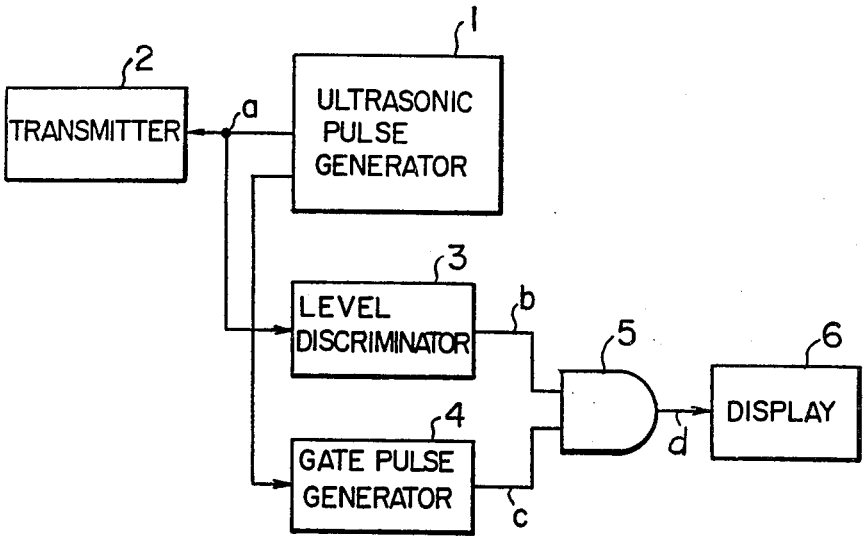
FIG. 1 is a block diagram showing the general structure of a first embodiment of the present invention.

Referring to FIG. 1 which is a block diagram showing the general structure of the first embodiment of the present invention, an ultrasonic pulse generator 1 applies a carrier wave of ultrasonic frequency in a pulse shape to an ultrasonic transmitter 2 which transmits the ultrasonic pulses produced by the ultrasonic pulse generator 1. An ultrasonic level discriminator 3 discriminates the level of excitation by the ultrasonic pulse generator 1, and the attenuation level of the damped oscillation signal appearing immediately after the excitation of the transmitter 2 by the ultrasonic pulse from the generator 1. A gate pulse generator 4 is associated with the ultrasonic pulse generator 1 to generate a gate pulse after generation of the ultrasonic pulses from the generator 1. The output of the ultrasonic pulse level discriminator 3 and the output of the gate pulse generator 4 are connected to an AND circuit 5 which provides an output signal indicative of the result of the AND logic operation on the signal applied from the level discriminator 3 and the gate pulse applied from the gate pulse generator 4. A display or alarm circuit 6 displays and indicates by a sound signal the operating condition of the ultrasonic apparatus.

Figure 2:
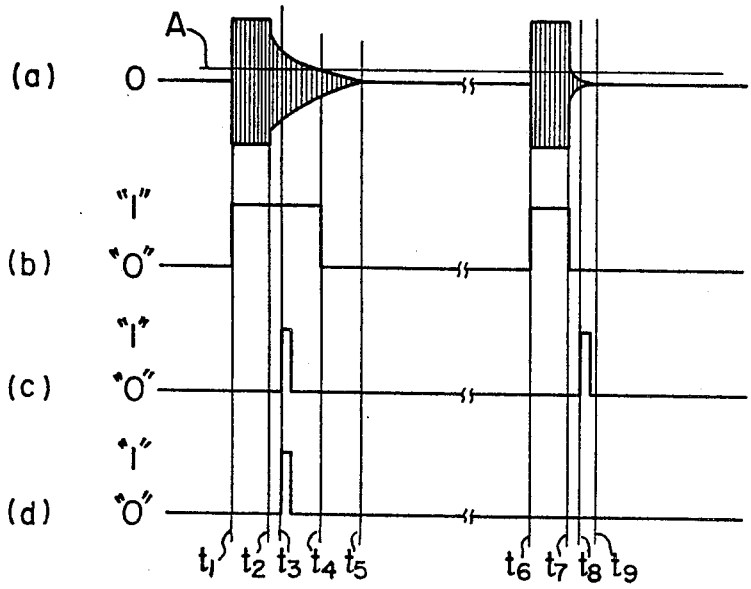
FIG. 2 shows various signal waveforms for illustrating the operation of the embodiment shown in FIG. 1.

The operation of the failure detecting device having the above structure will be described with reference to FIG. 2 showing signal waveforms appearing at various parts of FIG. 1.

FIG. 2 shows in (a) a waveform appearing at the connection point a between the ultrasonic pulse generator 1 and the ultrasonic transmitter 2. The waveform consists of a pulse-shaped waveform appearing during an excitation period of $(t_2-t_1)$ or $(t_7-t_6)$ by the ultrasonic pulse generator 1 and a damped waveform during a damped period of $(t_5-t_2)$ or $(t_9-t_7)$ after the excitation of the ultrasonic transmitter.

Suppose now that each component of the ultrasonic apparatus is operating normally or trouble-free. When the ultrasonic transmitter 2 is excited by the ultrasonic pulses generated from the ultrasonic pulse generator 1 from time $t_1$ to time $t_2$, the waveform appearing at the junction a is subject to oscillation damping from time $t_2$ to time $t_5$ as shown in (a) of FIG. 2 provided that the ultrasonic transmitter 2 is operating normally. When such a waveform is applied to the level discriminator 3 in which the threshold level is represented by A in (a) of FIG. 2, an output signal of "1" level appears from the level discriminator 3 from time $t_1$ to time $t_4$ as shown in (b) of FIG. 2. In response to an input signal applied after the generation of the ultrasonic pulses from the ultrasonic pulse generator 1, a gate pulse of "1" level appears from the gate pulse generator 4 at time $t_3$ to be applied as an input to the AND circuit 5, as shown in (c) of FIG. 2. In response to the application of the output signal of "1" level from the level discriminator 3 and the gate pulse of "1" level from the gate pulse generator 4, an output pulse of "1" level appears from the AND circuit 5 at time $t_3$ as shown in (d) of FIG. 2. This output pulse of "1" level is applied from the AND circuit 5 to the display circuit 6, and the trouble-free operation of the ultrasonic apparatus is displayed and indicated by a sound signal.

Suppose then that the ultrasonic transmitter 2 is not normally operating as, when, for example, foreign matters are attached to the surface of the transmitter 2 or the transmitter 2 is damaged, although the remaining parts of the ultrasonic apparatus are trouble-free. Then, the waveform from time $t_7$ to time $t_8$ does not represent a damped waveform of a sufficient amplitude and duration, as shown in (a) of FIG. 2, but the damped oscillation ceases in a short time. In a worst case, there appears no damped oscillation in that period of time. Consequently, in spite of the appearance of a gate pulse of "1" level at time $t_8$, as shown in (c) of FIG. 2, from the gate pulse generating circuit 4, no output pulse of "1" level appears from the AND circuit 5. Therefore, the sound signal indicative of the trouble-free operation is not generated from the display circuit 6, thereby indicating the presence of failure in the ultrasonic apparatus.

Suppose further that the ultrasonic transmitter 2 is not connected to the ultrasonic pulse generator 1 properly. Then, no damped oscillation appears after the excitation by the ultrasonic pulse generated from the ultrasonic pulse generator 1, and no output pulse of "1" level appears from the AND circuit 5 as in the above case. No output pulse of "1" level appears from the AND circuit 5 also when no output is generated from the ultrasonic pulse generator 1. In each of the above cases, therefore, the presence of failure in the ultrasonic apparatus can also be indicated.

It will be seen from the above description that the damped oscillation occurring after the excitation by the ultrasonic pulse can be utilized for the failure detection, so that whether or not the entire ultrasonic apparatus is operating trouble-free can be easily self-checked. Further, due to the fact that the self-check is based on the processing of the internal signals of the apparatus, the length of time required for the self-check can be made shorter than when a direct pulse is received for the detection of failure.

It is apparent that the manner of self-check is similar to that above described when the ultrasonic transmitter 2 is replaced by an ultrasonic receiver and a damped oscillation waveform is obtained from the junction between the ultrasonic pulse generator 1 and the ultrasonic receiver.

Figure 3:
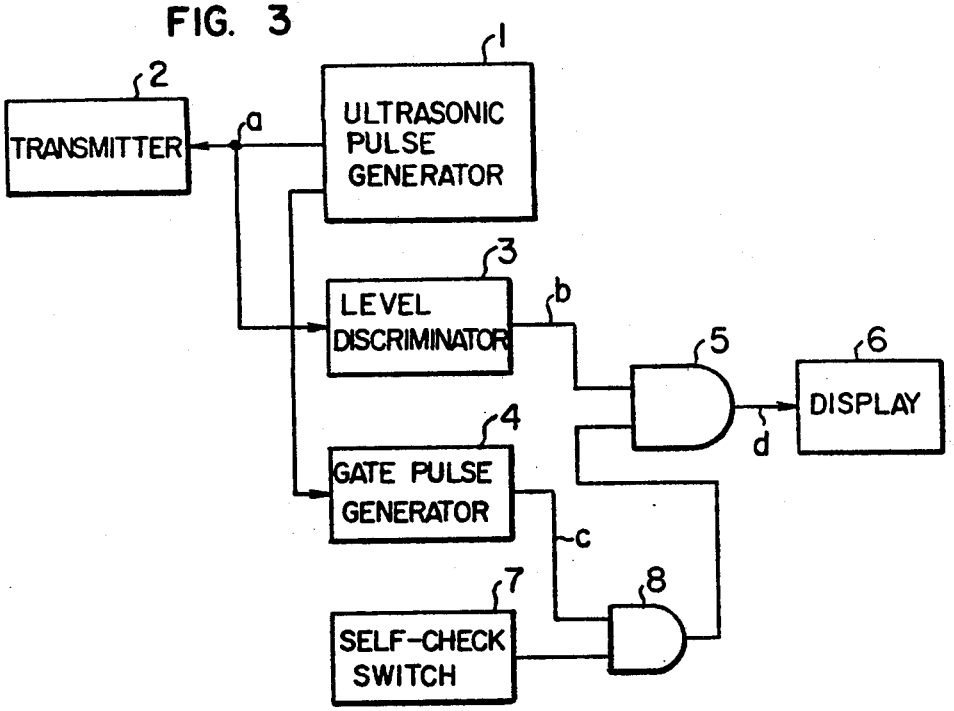
FIG. 3 is a block diagram showing the general structure of a second embodiment of the present invention.

FIG. 3 shows a second embodiment of the present invention in which the same reference numerals are used to designate the same parts appearing in FIG. 1. In FIG. 3, reference numerals 7 and 8 designate a self-check switch and a second AND circuit respectively. This second embodiment differs from the first embodiment in that the check circuit does not continuously perform the self-check but performs the self-check operation at any desired time in response to the appearance of an output signal of "1" level from the self-check switch 7.

This self-check switch 7 may be operated in any desired manner. When, for example, the ultrasonic apparatus is used for the detection of an obstruction lying in the reverse direction of an automobile, the self-check switch 7 may be arranged to operate in an interlocking relation with the reverse gear, and a timer circuit function may be additionally provided so that an output signal of "1" level appears from the self-check switch 7 for a period of time of, for example, 2 seconds after the transmission is shifted to the reverse gear position. In this manner, the self-check of the ultrasonic apparatus can be automatically performed for that period of time.

Further, although the display circuit 6 has been described to indicate the normal or trouble-free operating condition of the ultrasonic apparatus by a display and a sound signal, one of them may only be provided.

Figure 4:
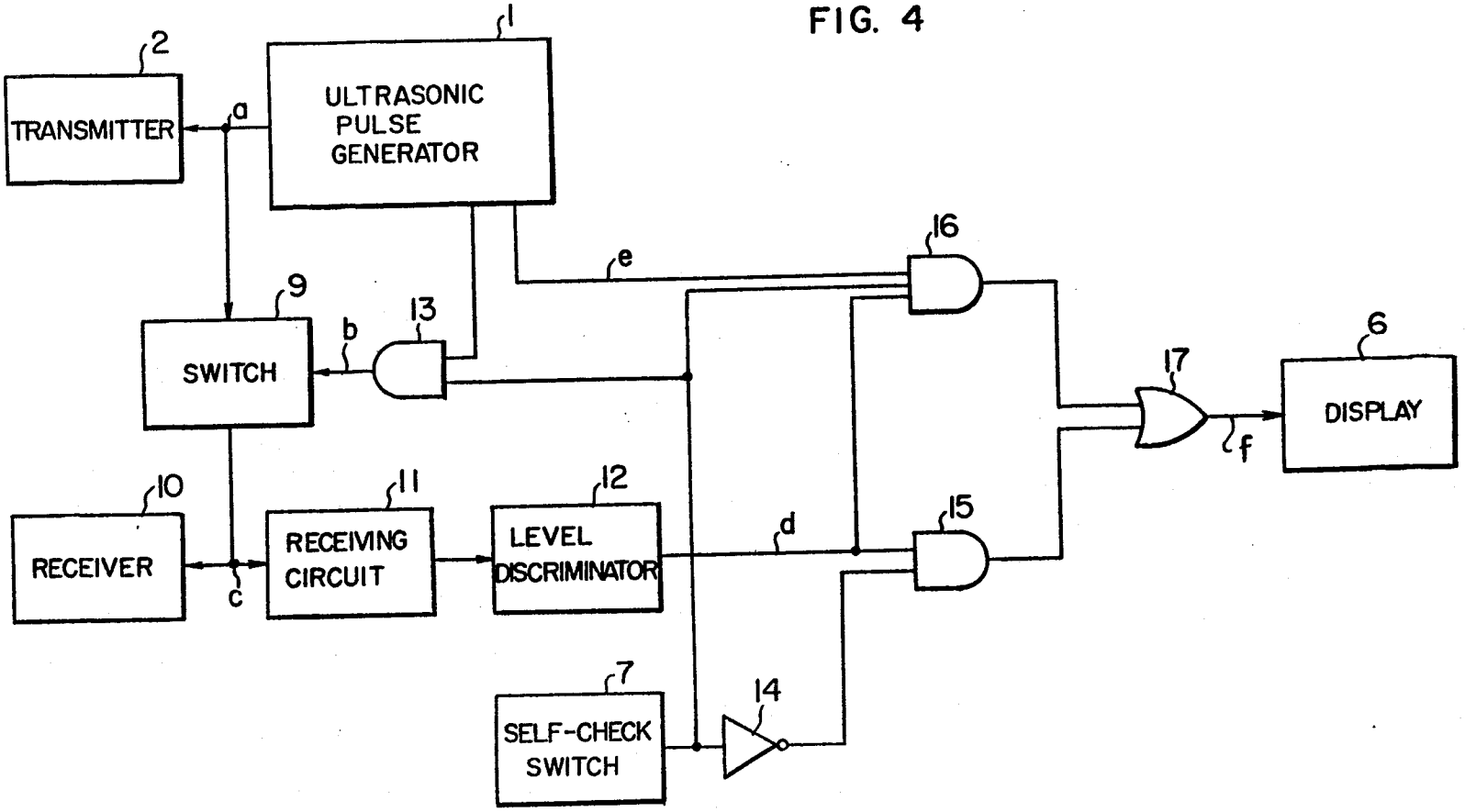
FIG. 4 is a block diagram showing the general structure of a third embodiment of the present invention.

Referring to FIG. 4 which is a block diagram showing the general structure of a third embodiment of the present invention, an ultrasonic pulse generator 1 generates an ultrasonic pulse signal of an ultrasonic carrier, a first gate signal for detecting failure of an ultrasonic transmitter 2 which transmits ultrasonic pulses by receiving the ultrasonic pulse signal from the ultrasonic pulse generator 1, and a second gate signal for detecting failure of an ultrasonic pulse receiving system. A switch 9 acts to apply a signal used for detecting a failure of the ultrasonic tramsitter 2 to an ultrasonic receiver 10. The receiver 10 receives an ultrasonic pulse reflected from an obstruction. A signal receiving circuit 11 connected to the ultrasonic pulse receiver 10 via a point c carries out amplification, signal selection and detection of the ultrasonic pulse signal received by the ultrasonic receiver 10. A level discriminator 12 compares the level of the signal detected by the signal receiving circuit 11 with a reference level thereby generating a resultant pulse signal.

The first gate signal generated from the ultrasonic pulse generator 1 for detecting failure of the ultrasonic transmitter 2 is applied to an AND circuit 13 together with a self-check signal appearing from a self-check switch 7 for the purpose of confirmation of trouble-free operation of the ultrasonic apparatus. The self-check signal from the self-check switch 7 is also applied through an inverter circuit 14 to a second AND circuit 15 to which the output signal from the level discriminating circuit 12 is also applied. The second gate signal generated from the pulse generating circuit 1 for detecting failure of the ultrasonic pulse receiving system is applied to a third AND circuit 16 together with the self-check signal from the self-check switch 7, and the output signal from the level discriminator 12. The output signals from the AND circuits 15 and 16 are applied to an OR circuit 17, and a display circuit 6 displays the operating condition in response to the output signal applied from the OR circuit 17.

Figure 5:
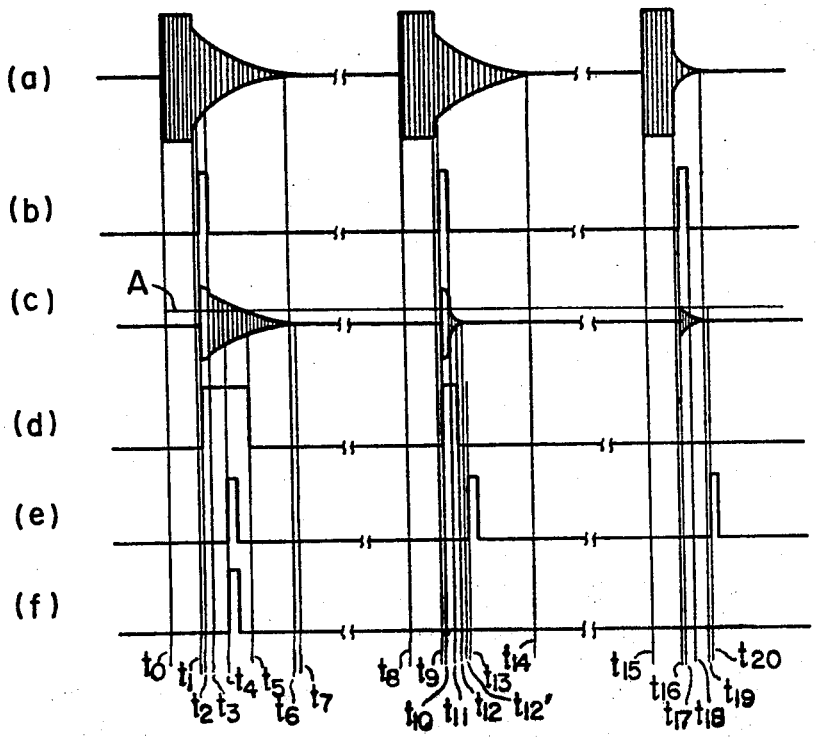
FIG. 5 shows various signal waveforms for illustrating the operation of the embodiment shown in FIG. 4.

The operation of the failure detecting device having the above structure will be described with reference to FIG. 5 showing signal waveforms appearing at various parts in FIG. 4. FIG. 5 shows in (a), (b), (c), (d), (e) and (f) the signal waveforms appearing at a, b, c, d, e and f respectively in FIG. 4. The waveform shown in (a) of FIG. 5 appears at the junction point a between the ultrasonic pulse generator 1 and the ultrasonic transmitter 2. The waveform includes excitation periods of time ($t_1$–$t_0$), ($t_9$–$t_8$) and ($t_{16}$–$t_{15}$) by the pulse generator 1 and damped periods of time ($t_6$–$t_1$), ($t_{14}$–$t_9$) and ($t_{19}$–$t_{16}$)

respectively after excitation of the ultrasonic transmitter 2.

Suppose now that the ultrasonic apparatus is operating trouble-free. Then, when the ultrasonic transmitter 2 is excited by the ultrasonic pulses generated from the ultrasonic pulse generator 1 from time $t_0$ to $t_1$, the waveform appearing at the junction point a is subject to oscillation damping from time $t_1$ to time $t_6$ as shown in (a) of FIG. 5. In response to the application of the self-check signal of "1" level from the self-checks switch 7 and the pulse signal of "1" level (the first gate signal for failure detection of the ultrasonic transmitter 2) from the ultrasonic pulse generator 1, an output signal of "1" level appears from the AND circuit 13 from time $t_2$ to time $t_3$ as shown in (b) of FIG. 5. The switch 9 is turned on during the period of time ($t_3$–$t_2$) in which the output signal of "1" level appears from the AND circuit 13, and an ultrasonic pulse (a portion of the damped oscillation signal) is applied to the junction point c between the ultrasonic receiver 10 and the signal receiving circuit 11. Suppose now that the ultrasonic receiver 10 is normally operating. Then, the damped ultrasonic pulse signal waveform portion is applied to the ultrasonic pulse receiver 10 from time $t_2$ to time $t_3$ as shown in (c) of FIG. 5, and the damped oscillation continues from time $t_3$ to time $t_7$ as shown in (c) of FIG. 5. When this waveform is applied to the signal receiving circuit 11, and the output signal from the signal receiving circuit 11 is applied to the level discriminator 12 in which the threshold level is represented by A in (c) of FIG. 5, an output signal of "1" level appears from the circuit 12 from time $t_2$ to time $t_5$ as shown in (d) of FIG. 5. The pulse signal of "1" level (the second gate signal for failure detection of the receiving system) is generated from the ultrasonic pulse generating circuit 1 at time $t_4$ as shown in (e) of FIG. 5 to be applied as a gate input to the AND circuit 16. The self-check signal of "1" level from the self-check switch 7 is also applied as another gate input to the AND circuit 16 together with the output signal of "1" level from the level discriminator 12. Consequently, an output pulse is applied from the AND circuit 16 to the OR circuit 17, and its output pulse appears at time $t_4$ as shown in (f) of FIG. 5. In response to the application of this pulse, the display circuit 6 indicates by a display and a sound signal that the ultrasonic transmitter 2 is operating normally or trouble-free.

When the ultrasonic transmitter 2 in the ultrasonic apparatus is operating trouble-free, and when the transmitter 2 is excited by the ultrasonic pulses generated from the ultrasonic pulse generating circuit 1 from time $t_8$ to time $t_9$, a damping oscillation appears from time $t_9$ to time $t_{14}$ as shown in (a) of FIG. 5. In response to the application of the self-check signal of "1" level from the self-check switch 7 and the pulse signal of "1" level (the first gate signal for failure detection of the ultrasonic pulse transmitter 2) from the ultrasonic pulse generator 1, an output signal of "1" level appears from the AND circuit 13 from time $t_{10}$ to time $t_{11}$ as shown in (b) of FIG. 5. The switch 9 is turned on during the period of time ($t_{11}$–$t_{10}$) in which the output signal of "1" level appears from the AND circuit 13, and a portion of the waveform shown in (a) of FIG. 5 is applied to the junction point c between the ultrasonic receiver 10 and the signal receiving circuit 11.

Suppose now that the ultrasonic receiver 10 is not normally operating as, when, for example, foreign matters are attached to the surface of the receiver 10 or the receiver 10 is damaged. Then, the damped oscillation does not continue sufficiently from time $t_{11}$ to time $t_{12}'$ as shown in (c) of FIG. 5, or the period of damped oscillation is short as shown in (c) of FIG. 5. In a worst case, there appears no damped oscillation. When such a waveform is applied to the signal receiving circuit 11, and its output signal is then applied to the level discriminator 12 in which the threshold level is represented by A in (c) of FIG. 5, an output signal of "1" level appears from the level discriminator 12 from time $t_{10}$ to time $t_{12}$ as shown in (d) of FIG. 5. Consequently, in spite of the application of the self-check signal of "1" level from the self-check switch 7 and the pulse signal of "1" level (the second gate signal) from the ultrasonic pulse generator 1 at time $t_{13}$ shown in (e) of FIG. 5, no output pulse appears from the AND circuit 16 at that time. Also, when the ultrasonic receiver 10 is not connected to the signal receiving circuit 11 properly, no input is applied to the signal receiving circuit 11, and no output pulse appears from the AND circuit 16 as in the above case.

Suppose then that the ultrasonic transmitter 2 is excited from time $t_{15}$ to time $t_{16}$ by the ultrasonic pulse from the ultrasonic pulse generator 1, and the transmitter 2 is not operating normally (or the ultrasonic receiver 10 is not operating normally as described above). Then, the waveform appearing at the junction point a does not have a sufficient damped oscillation from time $t_{16}$ to time $t_{19}$ as shown in (a) of FIG. 5, or the period of damped oscillation is short as shown in (a) of FIG. 5. In a worst case, there appears no damped oscillation. In such a case, no output pulse is applied from the OR circuit 17 to the display circuit 6. Therefore, the sound signal indicative of the trouble-free operation is not generated from the display circuit 6, thereby indicating the presence of failure in the ultrasonic apparatus. Also, when the ultrasonic pulse transmitter 2 is not connected properly to the ultrasonic pulse generator 1, no damped oscillation appears successive to the pulse excitation, and no output pulse appears from the OR circuit 17 as in-the above case.

When the self-check switch 7 is not operated and thus a signal of "0" level appears at the output of the self-check circuit 7, AND gates 13 and 16 are inhibited to operate, and the switch 9 is held non-conductive. As a result, the signal C which is inputted to the receiving circuit 11 includes only an ultrasonic wave which has been transmitted from the transmitter and then reflected back from the object. If the level of the reflected ultrasonic wave exceeds the threshold level A, the level discriminator 12 produces an output of "1" level which is applied to the AND gate 15. However, since the output of "0" level from the self-check switch 7 is inverted by the inverter 14 and the inverted signal of "1" level is applied also to the AND gate 15, the AND gate 15 produces a signal of "1" level which drives the display 6 via the OR gate 17. In other words, when the self-check switch 7 is not operated, the detection of the obstruction is reported by the fact that the display 6 is driven.

Although the display circuit 6 in the third embodiment of the present invention is used in common to the display of the result of self-check and the display of the result of detection of an obstruction in the normal operating condition of the ultrasonic apparatus, separate display circuits may be provided to serve the individual purposes. The self-check switch 7 may be operated in any desired manner. When, for example, the ultrasonic apparatus is used for the detection of an obstruction lying in the backward direction of an automobile, the self-check switch 7 may be arranged to operate in an interlocking relation with the reverse gear to generate the self-check signal of "1" level for a predetermined period of time after the transmission is shifted to the reverse gear position, so that the ultrasonic apparatus can be automatically inspected for the presence of failure in the reverse drive mode of the vehicle.

We claim:

1. In an ultrasonic apparatus which includes an ultrasonic pulse generator, an ultrasonic transmitter and an ultrasonic receiver, a device for detecting failure of said ultrasonic apparatus comprising:

means for picking up, from a junction point between said ultrasonic pulse generator and at least one of said ultrasonic pulse transmitter and said ultrasonic pulse receiver, a damped oscillation signal appearing after excitation of the at least one of said ultrasonic transmitter and said ultrasonic receiver by an ultrasonic pulse generated from said ultrasonic pulse generator; and means connected to said signal picking up means for detecting a failure of said ultrasonic apparatus on the basis of the state of the damped oscillation signal derived by said signal picking up means.

2. A device for detecting failure according to claim 1, wherein said means for detecting a failure includes a level detector for comparing said damped oscillation signal with a predetermined threshold level to determine a time length during which an amplitude of said damped oscillation signal exceeds said threshold level, and the failure of said ultrasonic apparatus is determined when said time length is smaller than a predetermined length of time.

3. In an ultrasonic apparatus which includes an ultrasonic pulse generator, an ultrasonic transmitter/-receiver constructed in a unit and operating on a time-division basis, a device for detecting failure of said ultrasonic apparatus comprising:

means for picking up, from a junction point between said ultrasonic pulse generator and said ultrasonic pulse transmitter/receiver, a damped oscillation signal appearing after excitation of the at least one of said ultrasonic transmitter and receiver on the time division basis by an ultrasonic pulse generated from said ultrasonic pulse generator; and means connected to said signal picking up means for detecting a failure of said ultrasonic apparatus on the basis of the state of the damped oscillation signal derived by said signal picking up means.

4. In an ultrasonic apparatus which includes an ultrasonic pulse generator, an ultrasonic transmitter, an ultrasonic receiver and a receiving circuit, a device for detecting failure of said ultrasonic apparatus comprising:

means for picking up, from a first junction point between said ultrasonic pulse generator and said ultrasonic transmitter, a first damped oscillation signal appearing after excitation of said ultrasonic transmitter by an ultrasonic pulse generated from said ultrasonic pulse generator;

means for applying a portion of said first damped oscillation signal to a second junction point between said ultrasonic receiver and said signal receiving circuit to excite said ultrasonic receiver by said first damped oscillation signal; and means for detecting a failure of said ultrasonic apparatus on the basis of the state of a second damped oscillation signal produced at said second junction point after excitation of said ultrasonic receiver by the portion of said first damped oscillation signal.

5. A failure detection device in an ultrasonic apparatus, said ultrasonic apparatus including an ultrasonic pulse generator and an ultrasonic transmitter connected to said ultrasonic pulse generator to be excited by an ultrasonic pulse therefrom, said failure detection device comprising:

comparison means, connected to a junction point between said ultrasonic pulse generator and said ultrasonic transmitter, and for comparing a signal obtained at said junction point with a reference level to produce a comparison output pulse having a width corresponding to a duration of said signal above said reference level, said signal obtained at said junction point consisting of the exciting ultrasonic pulse followed by a damped oscillation signal;

gate pulse producing means connected to said ultrasonic pulse generator for producing a gate pulse at a predetermined time after the exciting ultrasonic pulse;

means connected to receive said comparison output pulse and said gate pulse and for performing a logic AND operation to produce an output indicating that said damped oscillation signal has a sufficient magnitude and duration due to a normal operation of said ultrasonic transmitter.

6. A failure detection device according to claim 5, further comprising self-check switch means associated with said gate pulse producing means for allowing said gate pulse to enter said logic AND means only when said self-check switch means is operated thereby to allow the output of said logic AND means to be delivered in response to the operation of said self-check switch means.

7. A failure detection device in an ultrasonic apparatus, said ultrasonic apparatus including an ultrasonic pulse generator, an ultrasonic transmitter excited by an ultrasonic pulse from said ultrasonic pulse generator, an ultrasonic receiver, and a receiving circuit connected to said ultrasonic receiver, said failure detection device comprising:

switching means connected between first and second junction points, said first junction point being located between said ultrasonic pulse generator and said ultrasonic transmitter, said second junction point being located between said ultrasonic receiver and said receiving circuit, said switching means being closed for a predetermined period after excitation of said ultrasonic transmitter by the ultrasonic pulse and applying a portion of a first damped oscillation signal following the exciting ultrasonic pulse to said ultrasonic receiver;

said ultrasonic receiver being excited by said portion of the first damped oscillation signal to produce at said second junction point a second damped oscillation signal;

level discriminator means connected to said receiving circuit to receive said second damped oscillation signal therethrough and for comparing said second damped oscillation signal with a predetermined reference level thereby to produce an output pulse signal having a width varied depending on a magnitude and duration of said second damped oscillation signal; and failure determination means connected to receive said output pulse signal from said level discriminator means for determining the failure of said ultrasonic transmitter and receiving system including said ultrasonic receiving circuit depending on the duration of and the absence or presence of said output pulse signal.

* * * * *